US008514091B2

(12) United States Patent
Egawa

(10) Patent No.: US 8,514,091 B2
(45) Date of Patent: Aug. 20, 2013

(54) MULTIPLE ALARM SYSTEM WITH LOW BATTERY DETECTION FOR CONTROLLING TRANSMISSION AND RECEPTION OF AN ALARM SIGNAL

(75) Inventor: Yoshitaka Egawa, Machida (JP)

(73) Assignee: Hochiki Corporation, Tokyo (JP)

( * ) Notice: Subject to any disclaimer, the term of this patent is extended or adjusted under 35 U.S.C. 154(b) by 468 days.

(21) Appl. No.: 12/936,989

(22) PCT Filed: Mar. 17, 2009

(86) PCT No.: PCT/JP2009/055194
§ 371 (c)(1),
(2), (4) Date: Oct. 8, 2010

(87) PCT Pub. No.: WO2009/133726
PCT Pub. Date: Nov. 5, 2009

(65) Prior Publication Data

US 2011/0037603 A1 Feb. 17, 2011

(30) Foreign Application Priority Data

Apr. 28, 2008 (JP) ..... 2008-002727
Apr. 28, 2008 (JP) ..... 2008-002728

(51) Int. Cl.
*G08B 21/00* (2006.01)

(52) U.S. Cl.
USPC ..... 340/636.1; 340/506; 340/539.1; 340/628

(58) Field of Classification Search
USPC ..... 340/539.1, 628–630, 636.1–636.19, 340/506
See application file for complete search history.

(56) References Cited

U.S. PATENT DOCUMENTS 5,587,705 A 12/1996 Morris
6,624,750 B1 9/2003 Marman et al.

(Continued)

FOREIGN PATENT DOCUMENTS

GB 2443021 A 4/2008
JP 03-201196 9/1991

(Continued)

OTHER PUBLICATIONS

Japanese Patent Office; Search Report in International Patent Application No. PCT/JP2009/055194 dated Jun. 23, 2009; 2 pages.

(Continued)

*Primary Examiner* — Jeffery Hofsass

(57) ABSTRACT

The alarm device of the present invention includes a battery power supply; a sensor section that outputs an anomaly detection signal in the case of detecting an anomaly; an alert section that outputs an alarm based on the anomaly detection signal; a reception circuit section that discontinuously receives an event signal from another alarm device at every predetermined reception cycle; a transmission circuit section that transmits an event signal to the other alarm device in a transmission time that is at least the predetermined reception cycle; an anomaly monitoring section that, when the sensor section has detected an anomaly, causes the alert section to output the anomaly alarm based on the anomaly detection signal and causes the transmission of an event signal relating to the anomaly of the alarm device to the other alarm device by the transmission circuit section, and on the other hand, when the reception circuit section has received from the other alarm device an event signal relating to an anomaly of the other alarm device, causes the alert section to output the anomaly alarm; and a low battery monitoring section that, upon detecting a voltage drop of the battery power supply, causes a low battery alarm of the alarm device to be output by the alert section, and stops the transmission and reception of event signals in the transmission circuit section and the reception circuit section.

4 Claims, 15 Drawing Sheets

(56) References Cited

U.S. PATENT DOCUMENTS

| | | | |
|---|---|---|---|
| 2004/0203343 | A1 | 10/2004 | Schropp et al. |
| 2007/0149139 | A1 | 6/2007 | Gauvreau |
| 2008/0088439 | A1 | 4/2008 | Mehaffey |

FOREIGN PATENT DOCUMENTS

| | | | |
|---|---|---|---|
| JP | 3220828 | A | 9/1991 |
| JP | 3289295 | A | 12/1991 |
| JP | 11055176 | A | 2/1999 |
| JP | 2006-350412 | A | 12/2006 |
| JP | 2007-11828 | A | 1/2007 |
| JP | 2007-94719 | A | 4/2007 |
| WO | 2006044751 | A2 | 4/2006 |

OTHER PUBLICATIONS

European Search Report issued in Application No. 09738663.5-1232, dated Apr. 4, 2011, 10 pages.

European Office Action issued in Patent Application No. 09738663.5, dated Dec. 9, 2011, 6 pages.

Joannes Vergooson; Office Action issued in European Patent Application No. 09738663.5; Nov. 28, 2012; 8 pages; European Patent Office.

MULTIPLE ALARM SYSTEM WITH LOW BATTERY DETECTION FOR CONTROLLING TRANSMISSION AND RECEPTION OF AN ALARM SIGNAL

TECHNICAL FIELD

The present invention relates to an alarm device that detects an anomaly such as fire and performs an alarm, and also wirelessly transmits a signal to other alarm devices to perform linked alarm output.

Priority is claimed on Japanese Utility Model Application No. 2008-002727 and Japanese Utility Model Application No. 2008-002728, the content of which is incorporated herein by reference.

BACKGROUND ART

Residential alarms (hereinbelow referred to as "alarm devices") that emit an alarm upon detecting an anomaly such as a fire, gas leak or the like have become prevalent, and in recent years, there has been an increasing trend to perform monitoring for anomalies such as fires in every room by installing a plurality of alarm devices in a single residence (for example, refer to Patent Document 1).

In this way, when a plurality of alarm devices have been installed in a residence, in the case of a person being present in a separate room from the room in which an anomaly has occurred, there is the risk of the alarm sound not being audible to that person. For that reason, one has been proposed in which a linked alarm is possible by connecting alarm devices with wires, and so in the case of one alarm device having detected a fire and emitting an alarm, it is possible to transmit an alarm signal from that alarm device to the other alarm devices to cause them to sound simultaneously.

However, since wiring work is required in order to connect the alarm devices with wires, the problem arises of higher cost. The problem can be solved by adopting wireless alarm devices. Moreover, due to the reduced power consumption of wireless integrated circuits, even if placed in an operating state of being capable of always receiving a signal in order to be capable of receiving an alarm signal from another alarm device, a battery life that can withstand practical usage of over, for example, five years, is ensured. Therefore, the environment for making wireless alarm devices commercially viable is being put into place.

In such a wireless alarm device, since it is not known when a signal indicating an anomaly will be transmitted from another alarm device, it is necessary to put the reception circuit section in a standby operation state in order to be able to receive a signal at anytime. However, since the power consumption becomes large by doing so, the reception operation is designed to be performed discontinuously at every predetermined reception cycle.

[Patent Document 1] Japanese Unexamined Patent Application, First Publication No. 2007-094719

DISCLOSURE OF THE INVENTION

Problems to be Solved by the Invention

In an alarm device that uses a conventional battery power supply, when the battery voltage has fallen to a limit voltage in which normal functionality is possible over 72 hours (three days), it is designed to detect a low battery, and output a short alarm sound such as a "beep" once a minute for example.

However, when no one is at home for an extended period, such as one week, while the low battery alarm is emitted, the problem arises of the battery running down and the operation stopping without anyone noticing the low battery alarm, and thus entering a non-alert state.

The present invention has as its object to provide an alarm device that increases reliability by extending as much as possible the remaining time until a battery runs down even if a low battery alarm has been emitted.

Means for Solving the Problems

A first alarm device of the present invention is provided with: a battery power supply; a sensor section that outputs an anomaly detection signal in the case of detecting an anomaly; an alert section that outputs an alarm based on the anomaly detection signal; a reception circuit section that discontinuously receives an event signal from another alarm device at every predetermined reception cycle; a transmission circuit section that transmits an event signal to the other alarm device in a transmission time that is at least the predetermined reception cycle; an anomaly monitoring section that, when the sensor section has detected an anomaly, causes the alert section to output the anomaly alarm based on the anomaly detection signal and causes the transmission of an event signal relating to the anomaly of the alarm device to the other alarm device by the transmission circuit section, and on the other hand, when the reception circuit section has received from the other alarm device an event signal relating to an anomaly of the other alarm device, causes the alert section to output the anomaly alarm; and a low battery monitoring section that, upon detecting a voltage drop of the battery power supply, causes a low battery alarm of the alarm device to be output by the alert section, and stops the transmission and reception of event signals in the transmission circuit section and the reception circuit section.

A second alarm device of the present invention is provided with: a battery power supply; a sensor section that outputs an anomaly detection signal in the case of detecting an anomaly; a alert section that outputs an alarm based on the anomaly detection signal; a reception circuit section that discontinuously receives an event signal from another alarm device at every predetermined reception cycle; a transmission circuit section that transmits an event signal to the other alarm device in a transmission time that is at least the predetermined reception cycle; an anomaly monitoring section that, when the sensor section has detected an anomaly, causes the alert section to output the anomaly alarm based on the anomaly detection signal and causes the transmission of an event signal relating to the anomaly of the alarm device to the other alarm device by the transmission circuit section, and on the other hand, when the reception circuit section has received from the other alarm device an event signal relating to an anomaly of the other alarm device, causes the alert section to output the anomaly alarm; a low battery monitoring section that causes the output from the alert section of a low battery alarm that announces a voltage drop of the alarm device and the other alarm device; and a transmission and reception time control section that controls the transmission time of the transmission circuit section and the predetermined reception cycle of the reception circuit section. When a voltage drop of the battery power supply is detected, the low battery monitoring section causes the alert section to output a low battery alarm of the alarm device, and causes the transmission circuit section to transmit an event signal relating to the voltage drop of the alarm device to the other alarm device, and the transmission and reception time control section changes the predetermined reception cycle of the reception circuit section to a long reception cycle that is longer than the predetermined reception cycle; and when an event signal relating to a voltage drop of the other alarm device is received from the other alarm device, the low battery monitoring section causes the alert section to output a low battery alarm of the other alarm device, and the transmission and reception time control section changes the transmission time of the transmission circuit section to a time equal to or greater than the long reception cycle.

The low battery monitoring section may detect the voltage drop when the battery voltage has dropped to a limit voltage at which the normal function of the alarm device can be maintained over a predetermined remaining time.

Effects of the Invention

With the aforementioned first alarm device of the present invention, when the battery voltage drops and a low battery is detected, due to stopping the transmission of event signals to another alarm device and the reception of event signals from another alarm device that have been performed until then, it is possible to eliminate current consumption by the transmission circuit section and the reception circuit section. As a result, the time until the battery runs down is extended, and even if a low battery is detected and an alarm is issued, it is possible to prevent as much as possible a non-alert state due to the battery running down while no one is present.

With the aforementioned second alarm device of the present invention, when the battery voltage drops and a low battery is detected, due to changing the discontinuous reception cycle until then to a longer cycle, it is possible to reduce the average consumption current of the reception circuit section. As a result, the time until the battery runs down is extended, and even if a low battery is detected and an alarm is issued, it is possible to prevent as much as possible a non-alert state due to the battery running down while no one is present.

DESCRIPTION OF REFERENCE NUMERALS

Figure 1B:
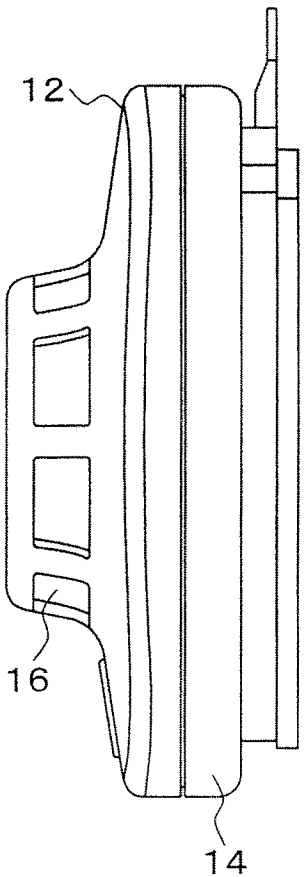
FIG. 1B is a side elevational drawing that shows the exterior appearance of the alarm device.

10, 10-1 to 10-5 alarm device
12 cover
14 main unit
15 mounting hook
16 smoke detector section
18 sound hole
20 alarm stop switch
22 LED
24 residence
26 garage
28 CPU
30 wireless circuit section
31 antenna
32 storage circuit section
34 sensor section
36 alert section
38 operating section
40 battery power supply
42 transmission circuit
44 reception circuit
46 memory
48 event signal
50 transmission source code
52 group code
54 event code
56 speaker
58 anomaly monitoring section
60 low battery monitoring section
110, 110-1 to 110-5 alarm device
112 cover
114 main unit
115 mounting hook
116 smoke detector section
118 sound hole
120 alarm stop switch
122 LED
124 residence
126 garage
128 CPU
130 wireless circuit section
131 antenna
132 storage circuit section
134 sensor section
136 alert section
138 operating section
140 battery power supply
142 transmission circuit
144 reception circuit
146 memory
148 event signal

150 transmission source code
152 group code
154 event code
156 speaker
158 anomaly monitoring section
160 low battery monitoring section
162 transmission and reception time control section

BEST MODE FOR CARRYING OUT THE INVENTION

First Embodiment

Figure 1A:
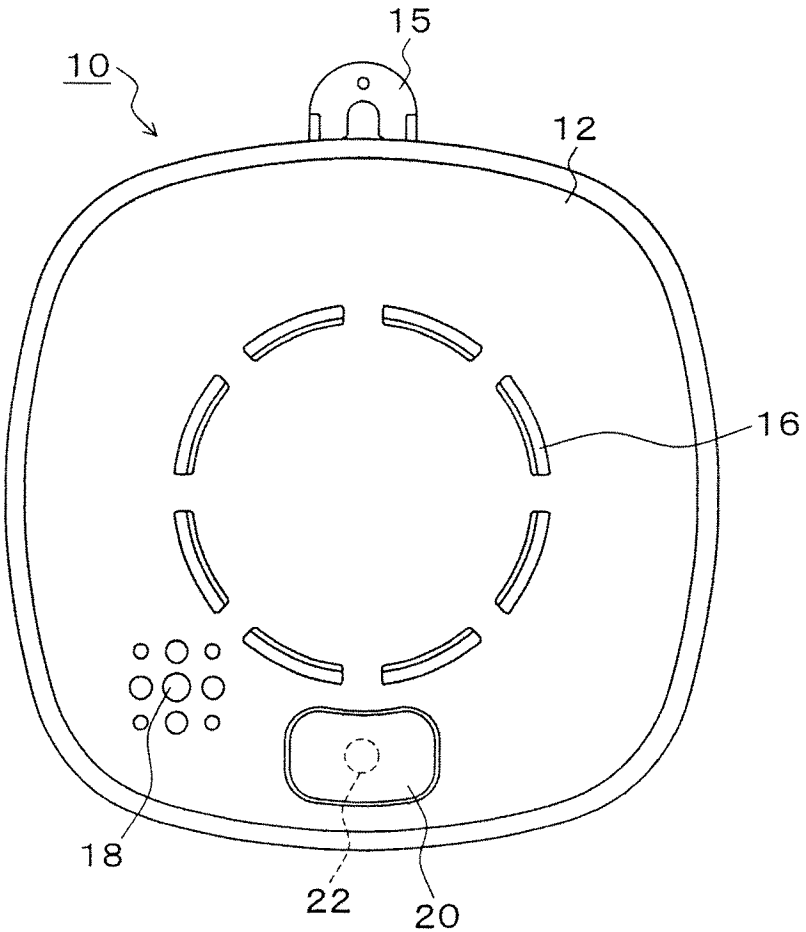
FIG. 1A is a front elevational drawing that shows the exterior appearance of the alarm device of the first embodiment of the present invention.

The exterior appearance of the wireless alarm device of the present invention is shown in FIG. 1A and FIG. 1B, with FIG. 1A showing a front elevation, and FIG. 1B showing a side elevation.

In FIG. 1A and FIG. 1B, an alarm device 10 of the present embodiment is provided with a cover 12 and a main unit 14. A smoke detector section 16 in which openings that serve as smoke inlets are formed is arranged in the center of the cover 12, and when smoke from a fire reaches a predetermined density, it detects a fire.

As shown in FIG. 1A, a sound hole 18 is provided on the lower left side of the smoke detector section 16 of the cover 12. A speaker is built in at the rear of the sound hole 18 and outputs an alarm sound or voice message through this sound hole 18. An alarm stop switch 20 is provided on the lower side of the smoke detector section 16. The alarm stop switch 20 also has a function as a check switch.

An LED 22 as shown by the dotted line is arranged within the alarm stop switch 20. When the LED 22 turns on, the light therefrom passes through the portion of the switch cover of the alarm stop switch 20, and so the turned on state of the LED 22 can be confirmed from outside.

An mounting hook 15 is provided on the upper portion of the underside the main unit 14, and by screwing in a screw (not illustrated) into a wall of a room where it is to be installed, and attaching the mounting hook 15 onto this screw, it is possible to install the alarm device 10 on a wall.

Note that the alarm device 10 that is shown in FIG. 1A and FIG. 1B shows an example of the constitution that detects smoke from a fire with the smoke detector section 16, but in addition an alarm device that is provided with a thermistor that detects heat from a fire, or an alarm device that detects a gas leak besides a fire are included in the scope of the present invention.

Figure 2:
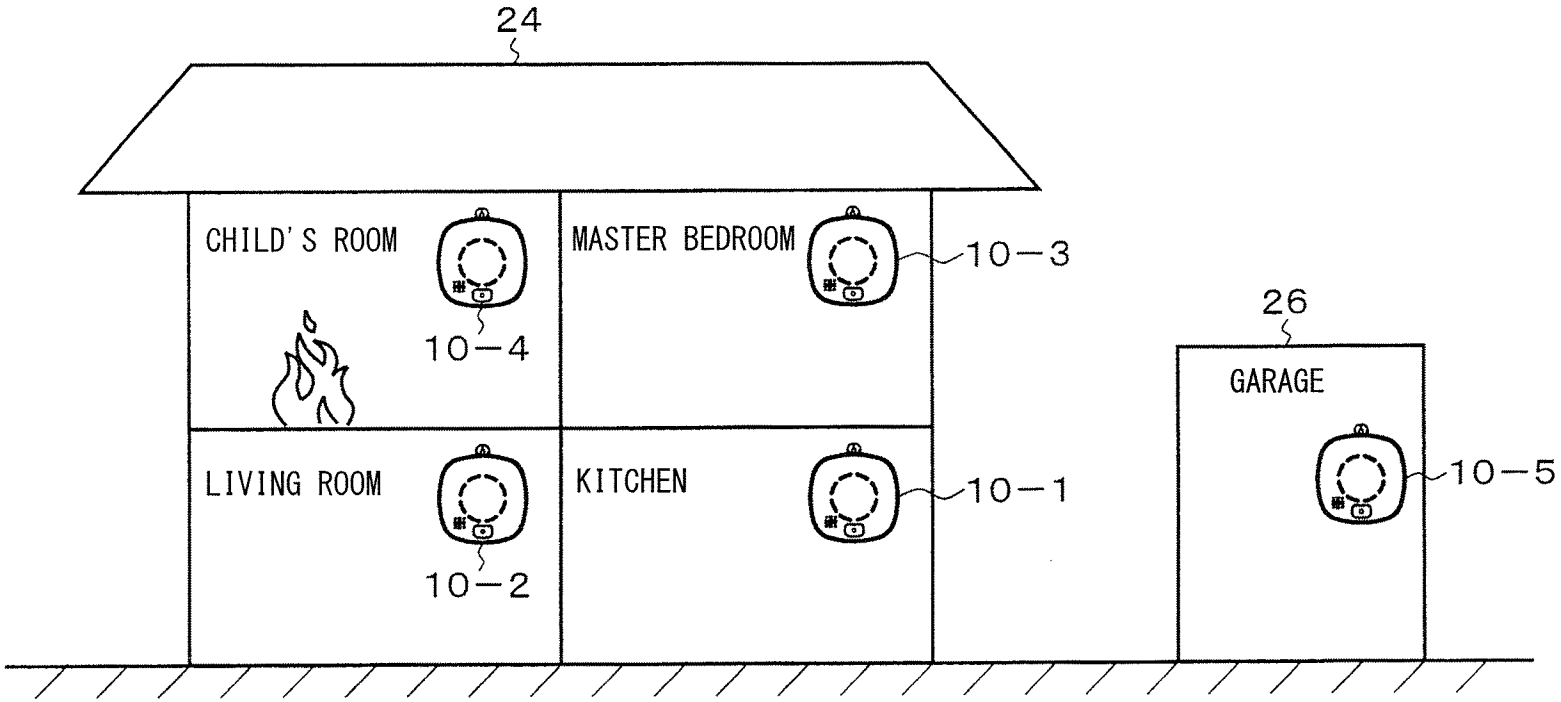
FIG. 2 is an explanatory drawing that shows the state of the alarm device installed in a residence.

FIG. 2 is an explanatory drawing that shows the state of the alarm device of the present embodiment installed in a residence. In the example of FIG. 2, alarm devices 10-1 to 10-4 of the present embodiment are installed in the kitchen, living room, master bedroom, and a child's room of a residence 24, and moreover, an alarm device 10-5 is installed in a garage 26 that is built outside.

The alarm devices 10-1 to 10-5 are each provided with a function to mutually transmit and receive wirelessly an event signal, and the five alarm devices 10-1 to 10-5 constitute one group to perform fire monitoring of the entire residence 24.

In the case of a fire occurring for example in the child's room of the residence 24, the alarm device 10-4 detects the fire and starts an alarm. The detection of the fire and starting of the alarm is called "alarm activation" in the alarm device. When the alarm device 10-4 activates an alarm, the alarm device 10-4 functions as the linked source, and transmits wirelessly the event signal that indicates a fire alarm activation to the other alarm devices 10-1 to 10-3 and 10-5 that serve as linked destinations. When the other alarm devices 10-1 to 10-3 and 10-5 receive the event signal that indicates fire alarm activation from the alarm device 10-4 that is the linked source, they perform an alarm operation as linked destinations.

As the alarm sound of the alarm device 10-4 that is the linked source, for example, the voice message "Woo Woo . . . The fire alarm has been activated. Please confirm" is output continuously. Meanwhile, in the linked destination alarm devices 10-1 to 10-3 and 10-5, the voice message "Woo Woo . . . Another fire alarm has been activated. Please confirm" is output continuously. In the state of the alarm devices 10-1 to 10-5 outputting the alarm sound, when the alarm stop switch 20 that is provided on the alarm device shown in FIG. 1A is operated, the stop process of the alarm sound is performed.

Also, the alarm devices 10-1 to 10-5 are provided with a low battery monitoring function that monitors the running down of the battery, and when it detects a low battery, for example, it intermittently outputs a "beep" alarm sound at a predetermined time interval, and reports that a failure has occurred.

Furthermore, when a low battery is detected in the alarm devices 10-1 to 10-5 of the present embodiment, upon being transmitted to the other alarm devices by a transmission circuit 42, they operate so as to stop reception from the other alarm devices by a reception section 44.

Note that the alarm devices 10-1 to 10-5 monitor for a sensor failure besides a low battery, and when they detect a sensor failure, perform a linked alarm in the same manner as the low battery detection.

Figure 3:
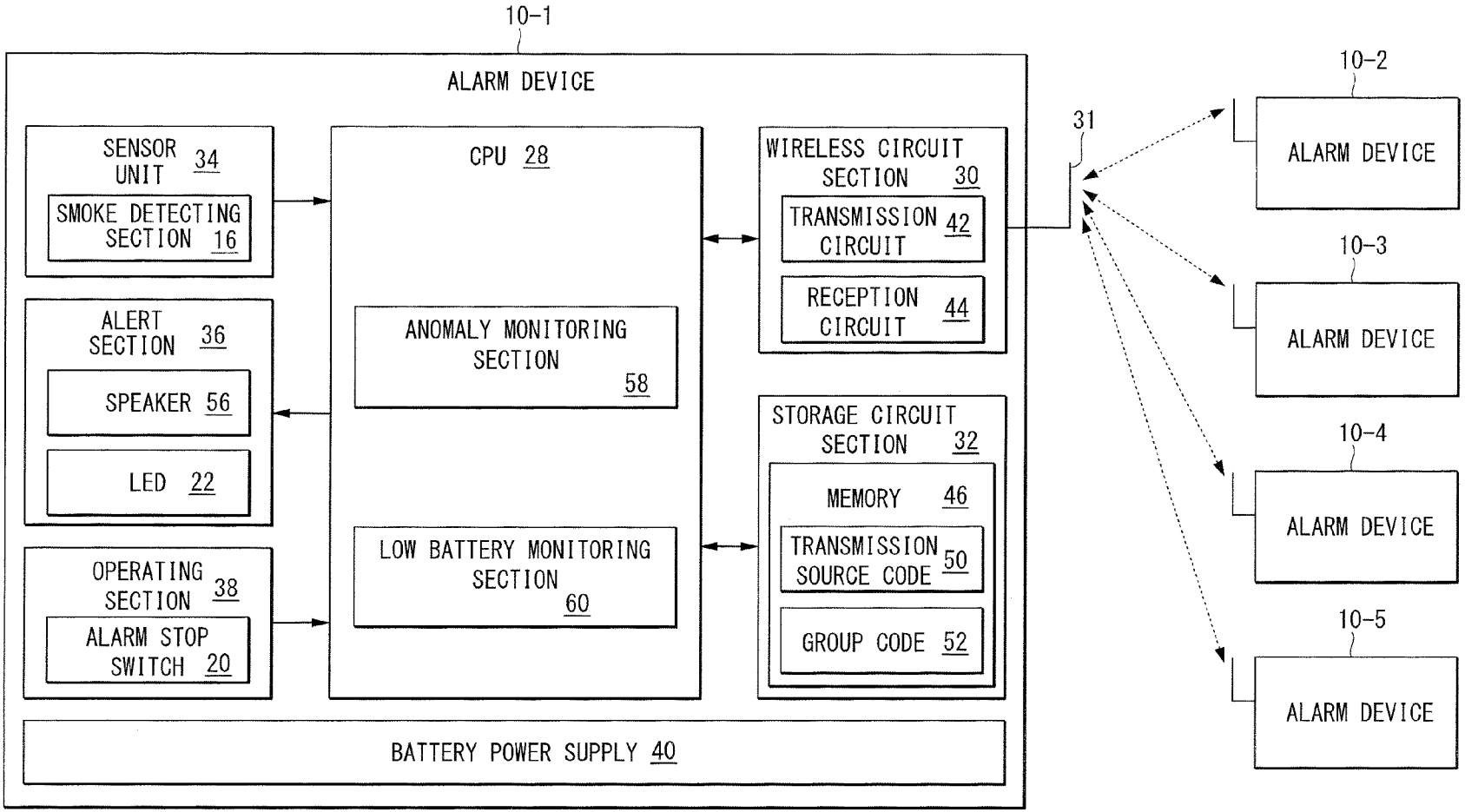
FIG. 3 is a block diagram of the alarm system that is used in the alarm device.

FIG. 3 is a block diagram that shows the constitution of the alarm device of the present embodiment. FIG. 3 shows in detail the circuit configuration of the alarm device 10-1, among the five alarm devices 10-1 to 10-5 shown in FIG. 2.

The alarm device 10-1 is provided with a CPU 28. Also, corresponding to this CPU 28, it is further provided with a wireless circuit section 30 that is provided with an antenna 31, a storage circuit section 32, a sensor section 34, an alert section 36, an operating section 38, and a battery power supply 40.

The wireless circuit section 30 is provided with the transmission circuit 42 and the reception circuit 44, and is designed to be capable of wirelessly transmitting and receiving event signals to/from the other alarm devices 10-2 to 10-5. As the wireless circuit section 30, in Japan it is preferable to adopt a constitution based on for example STD-30, which is known as the standard for specified low-power radio stations in the 400 MHz band (ARIB Standard for Radio Equipment for Radio Station of Low Power Security System), or STD-T67 (ARIB Standard for Telemeter, Telecontrol and Data Transmission Radio Equipment for Specified Low Power Radio Stations).

Of course, as the wireless circuit section 30, for places outside of Japan, it is preferable to adopt a constitution that is based on the standard for allocated radio stations of that region.

The reception circuit 44 performs a discontinuous reception operation. The discontinuous reception operation of the reception circuit 44 consists of a reception operation time of for example T1=5 milliseconds, followed by a sleep time of for example T2=10 seconds, resulting in discontinuous reception with a cycle T12 (=T1+T2). Corresponding to this discontinuous reception, the transmission circuit 42 continuously transmits the event signal over time T3 that is at least the discontinuous reception cycle T12 (=T1+T2).

The discontinuous reception cycle T12 of the reception circuit 44 is a cycle that is determined at the design stage of the alarm device, so as to lead to an average current consumption that ensures a battery life of for example 10 years.

Moreover, the transmission circuit 42 and the reception circuit 44 of the present embodiment stop the transmission and reception so as to extend the battery life by a control signal from the CPU 28 when a low battery is detected.

A memory 46 is provided in the storage circuit section 32. A transmission source code 50 that serves as an ID (identifier) that specifies the alarm device, and a group code 52 for constituting a group that performs a linked alarm with a plurality of alarms as shown in FIG. 2 is housed in the memory 46. As for the transmission source code 50, the number of alarm devices to be provided domestically is calculated, and for example a code of 26 bits is used so that the same code does not overlap.

The group code 52 is a code that is set so as to be common for the plurality of alarm devices that constitute a group, and when the group code that is included in the event signal from another alarm device that is received by the wireless circuit section 30 matches the group code 52 that is registered in the memory 46, that event signal is received as a valid signal and processed.

Note that in the present embodiment, the memory 46 is used in the storage circuit section 32, but a DIP switch may be provided instead of the memory 46, so that the transmission source code 50 and the group code 52 may be set by this DIP switch. In the case of the bit length (bit number) of the transmission source code 50 and the group code 52 being short, the storage circuit section 32 that uses a DIP switch is preferred.

In the present embodiment, the smoke detector section 16 is provided in the sensor section 34, and outputs a smoke detection signal corresponding to the smoke density to the CPU 28. Besides the smoke detector section 16, a thermistor that detects the temperature from a fire may be provided. Also, in the case of an alarm device for detecting gas leaks, a gas leak sensor is provided in the sensor section 34.

The speaker 56 and the LED 22 are provided in the alert section 36. The speaker 56 outputs a voice message from a speech synthesis circuit section that is not illustrated or an alarm sound. The LED 22, by blinking and flashing, or turning on, indicates an anomaly such as a fire or a failure.

The alarm stop switch 20 is provided in the operating section 38. When the alarm stop switch 20 is operated, it is possible to stop the alarm sound that is sounding from the alarm device 10-1. The alarm stop switch 20 also doubles as a check switch in the present embodiment.

The alarm stop switch 20 is in effect when the alert section 36 is outputting an alarm sound from the speaker 56. On the other hand, during the normal monitoring state when an alarm sound is not being output, the alarm stop switch 20 functions as a check switch, and when the check switch is pushed, a voice message for inspection is output from the alert section 36.

The battery power supply 40 uses for example alkaline dry cells of a predetermined number, and regarding the battery capacity, a battery service life of about 10 years is ensured due to the reduced power consumption of the entire circuit section including the wireless circuit section 30 in the alarm device 10-1.

In the CPU 28, an anomaly monitoring section 58 and a low battery monitoring section 60 are provided as functions that are realized by the execution of programs.

When the smoke detection signal from the smoke detector section 16 that is provided in the sensor section 34 exceeds the fire level and thus detects a fire, the anomaly monitoring section 58 causes the repeated output of, for example, "Woo Woo . . . The fire alarm has been activated. Please confirm" as the voice message that is the alarm sound indicating the linked source from the speaker 58 of the alert section 36, and causes the transmission of an event signal that indicates fire alarm activation from the antenna 31 to the other alarm devices 10-2 to 10-5 by the transmission circuit 42 of the wireless circuit section 30.

Also, when an event signal that indicates fire alarm activation has been received from any of the other alarm devices 10-2 to 10-5 by the reception circuit 44 of the wireless circuit section 30, the anomaly monitoring section 58 causes an alarm sound indicating the linked destination, for example, the voice message "Woo Woo . . . Another fire alarm has been activated. Please confirm" to be output continuously from the speaker 56 of the alert section 36.

Here, when the anomaly monitoring section 58 has detected a fire alarm activation and outputs the linked source alarm sound, the LED 22 of the alert section 36 is made to blink, for example. On the other hand, in the case of outputting a linked destination alarm sound, the LED 22 of the alert section 36 is made to flash. Thereby, it is possible to distinguish between the linked source alarm and the linked destination alarm from the indication of the LED 22. Of course, either of the linked source alarm and the linked destination alarm may be a blinking or flashing display of the same LED 22.

When the low battery monitoring section 60 has detected a low battery due to a voltage drop of the battery power supply 40, it emits a short low battery alarm sound such as a "beep" once every minute, for example, and also stops transmission to the other alarm devices by the transmission circuit 42 and reception from the other alarm devices by the reception circuit 44. Specifically, a switching means is provided, for example, in the power supply line to the transmission circuit 42 and the reception circuit 44, and by opening this switching means, the supply of power thereto is stopped.

Here, when the battery voltage of the battery power supply 40 has dropped to a limit voltage at which the alarm device is capable of normally functioning over a predetermined remaining time, the low battery monitoring section 60 detects a low battery.

Figure 4:
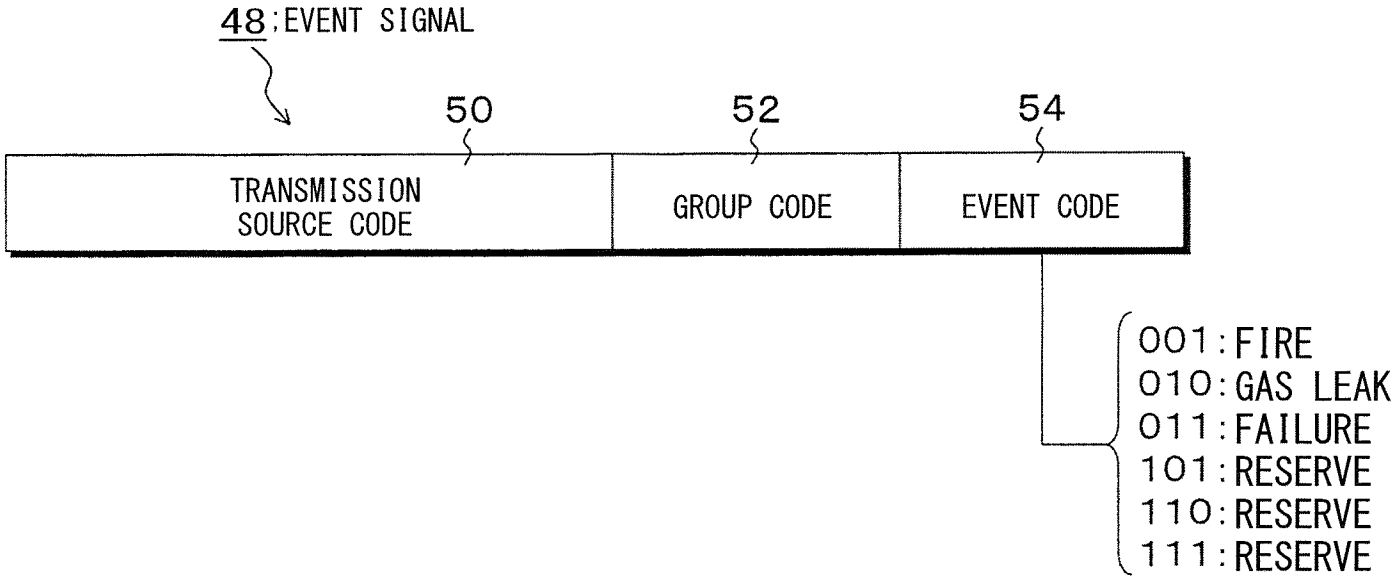
FIG. 4 is an explanatory drawing that shows the format of the event signal that is used in the embodiment.

FIG. 4 is an explanatory drawing that shows the format of the event signal used in the present embodiment. As shown in FIG. 4, an event signal 48 is constituted by the transmission source code 50, the group code 52, and the event code 54. The transmission source code 50 is for example a code of 26 bits. Also, the group code 52 is for example a code of 8 bits, and the same group code is set for the five alarm devices 10-1 to 10-5 of FIG. 3, for example, that constitute the same group.

Note that as the group code 52, the same group code may be set for each alarm device of the same group, but in addition, it may be a group code differing for each alarm device that is found from arithmetic of a reference code that is common to each alarm device that constitutes a group that is defined in advance, and a transmission source code that is unique to each alarm device.

The event code 54 is a code that expresses the event content of an anomaly such as a fire or gas leak or a failure. In the present embodiment, a three-bit code is used, with for example "001" denoting a fire, "010" denoting a gas leak, "011" denoting a failure, and the remainder serving as a reserve.

Note that by increasing the bit number of the event code 54 to four bits or five bits when the type of events has increased, it is possible to express several types of event contents.

Figure 5:
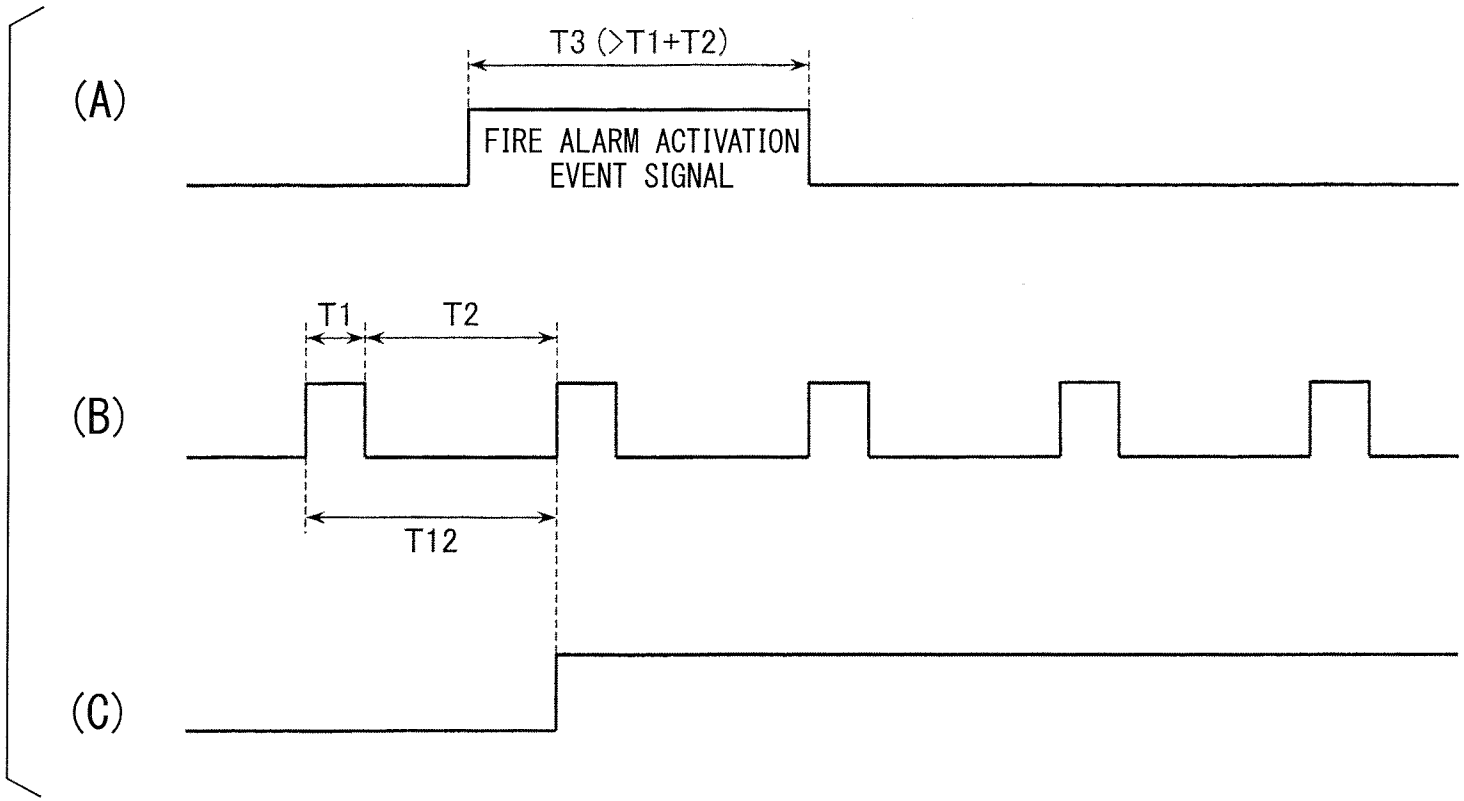
FIG. 5 is a time chart that shows the normal operation on the transmission side and the reception side in the embodiment.

FIG. 5 is a time chart that shows the normal operation on the transmission side and the reception side in the present embodiment. In FIG. 5, (A) shows the transmission operation of the transmission side alarm device, (B) is the reception operation of the reception side alarm device, and (C) is the alarm output operation of the reception side alarm device.

As shown in (B) of FIG. 5, in the reception side alarm device, during the normal monitoring state a discontinuous reception operation is performed at the discontinuous reception cycle T12 (=T1+T2) that consists of the reception operation time T1 and the sleep time T2 that are initially set. Here, the reception operation time T1 is for example T1=5 milliseconds, and the sleep time T2 is for example T2=10 seconds, and so the discontinuous reception cycle T12 becomes T12=approximately 10 seconds.

In this state, when the transmission side alarm device performs fire alarm activation at an arbitrary timing, an event signal that indicates the fire alarm activation is transmitted as shown in (A) of FIG. 5. The transmission time T3 of the fire alarm activation event signal is made to be at least the discontinuous reception cycle T12. Thereby, even if the transmission timing is any timing, at least one reception time T1 occurs during the transmission time T3, and even if by discontinuous reception, it is possible to reliably receive the event signal, and to extend the battery life.

Figure 6:
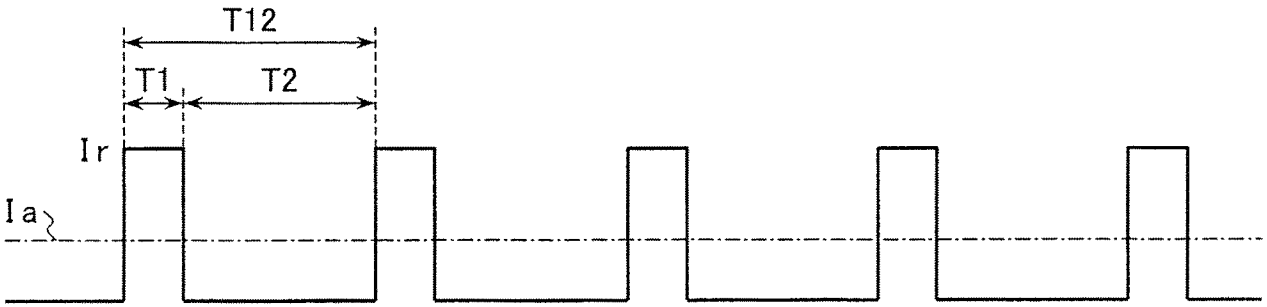
FIG. 6 is a time chart that shows the average consumption current due to discontinuous reception in the embodiment.

FIG. 6 is a time chart that shows the relationship between the discontinuous reception cycle and the average consumption current at normal times. The average current Ia in this case is given by $$Ia=(Ir\times T1)/T12$$

In the present embodiment, since the reception circuit 44 stops based on the detection of a low battery, it is possible to make the average current Ia 0 by discontinuous reception. Also, based on the detection of a low battery, transmission of the event signal to other alarm devices by the transmission circuit 42 shown in (A) of FIG. 5 also stops, and the consumption current of the battery power supply 40 decreases by that much. As a result, even when the battery power supply 40 is in a low battery state, it is possible to extend the battery life as much as possible.

Figure 7:
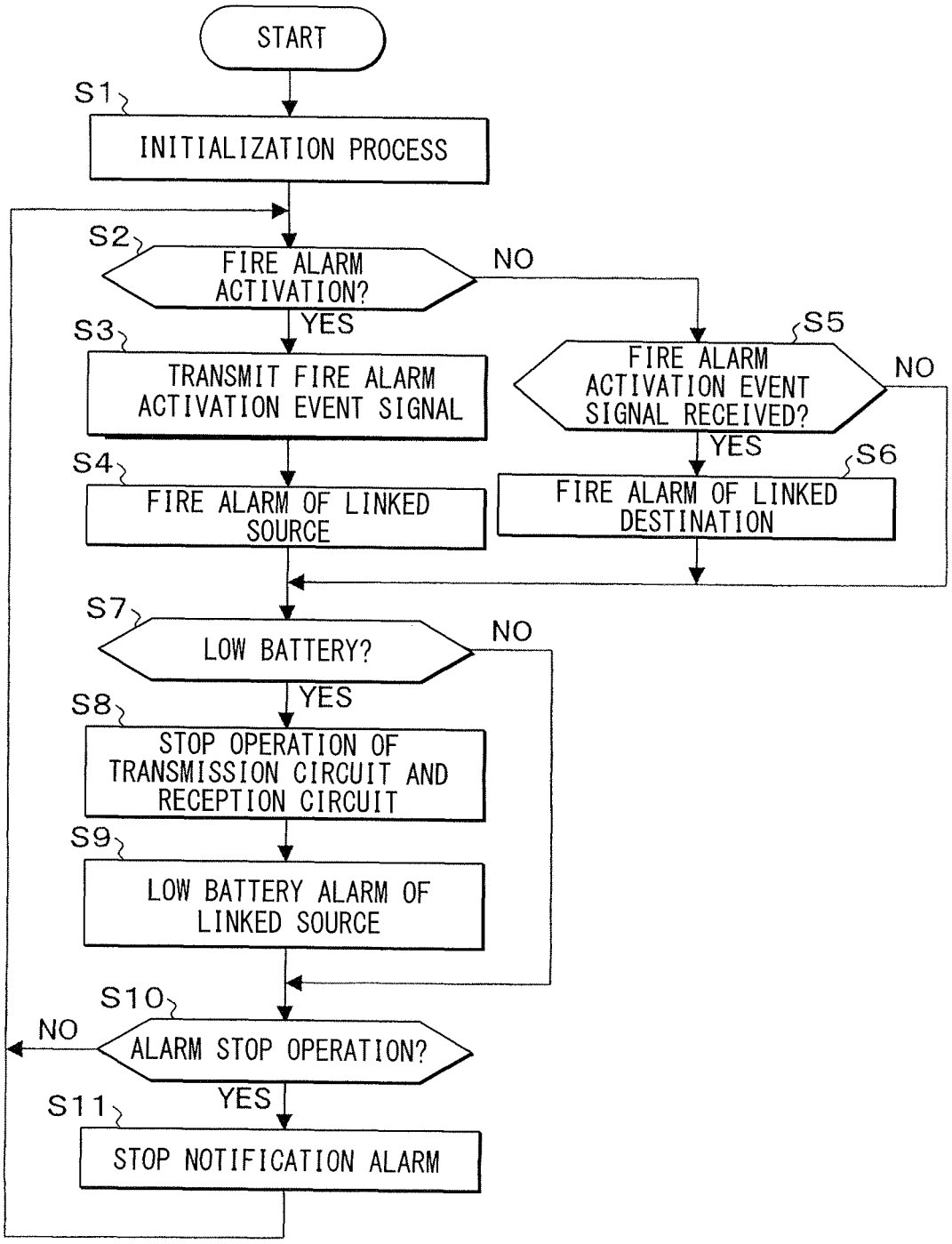
FIG. 7 is a flowchart that shows the processes by the CPU that is provided in the alarm device of FIG. 3.

FIG. 7 is a flowchart that shows the process by the CPU 28 that is provided in the alarm device 10-1 of FIG. 3. When the battery power supply of the alarm device is made effective (ON), in Step S1, an initialization process is performed. In this initialization setting, a process that sets a linked group with the alarm devices 10-1 to 10-5 is included.

Next, the alarm device enters the monitoring state, and in Step S2, the presence of a fire alarm activation by the smoke detector section 16 that is provided in the sensor section 32 is determined. When a fire alarm activation is determined, the process proceeds to Step S3, and after transmitting the fire alarm activation event signal to the other alarm devices 10-2 to 10-5, in Step S4 the fire alarm of the linked source is acoustically output from the speaker 56 of the alert section 36 and the LED 22 is controlled to turn on.

Meanwhile, in the case of a fire alarm activation not being determined in Step S2, the process proceeds to Step S5, in which it is determined whether or not a fire alarm activation event signal has been received from another alarm device, and when the reception of a fire alarm activation event signal is determined, a fire alarm of the linked destination is output in Step S6.

Next, in Step S7 the presence of a low battery detection is determined, but normally if there is no low battery detection the process proceeds to Step S10, and in Step S10 when the alarm stop operation during an alarm is determined, the alarm sound is stopped in Step S11.

Also, in the case of a low battery detection being determined in Step S7, the process proceeds to Step S8, and when the transmission operation of the event signal to another alarm device by the transmission circuit 42 and the reception operation of an event signal from another alarm device by the reception circuit 44 are stopped, the battery life of the battery power supply 40 in which the low battery is detected is extended.

Note that in the aforementioned embodiment, an alarm device intended for fire detection was taken as an example, but even for alarm devices that detect other appropriate anomalies, such as an alarm device for gas leaks or an alarm device for crime prevention, it is possible to apply as is the monitoring process that includes the preliminary anomaly of the present embodiment. Also, it is not limited to residences, and can be also applied to alarm devices for various uses such as for buildings and offices.

Also, the aforementioned embodiment is one that takes as an example the case of integrally providing the sensor section in the alarm device, but it may also be an alarm device in which the sensor section is provided separately from the alarm device.

Second Embodiment

Figure 8B:
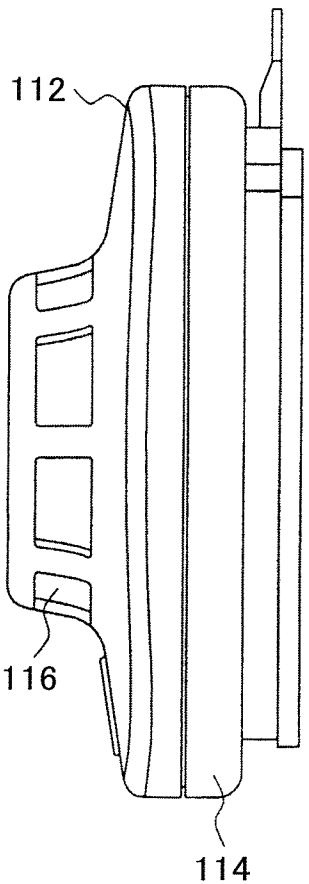
FIG. 8B is a side elevational drawing that shows the exterior appearance of the alarm device of the embodiment.
Figure 8A:
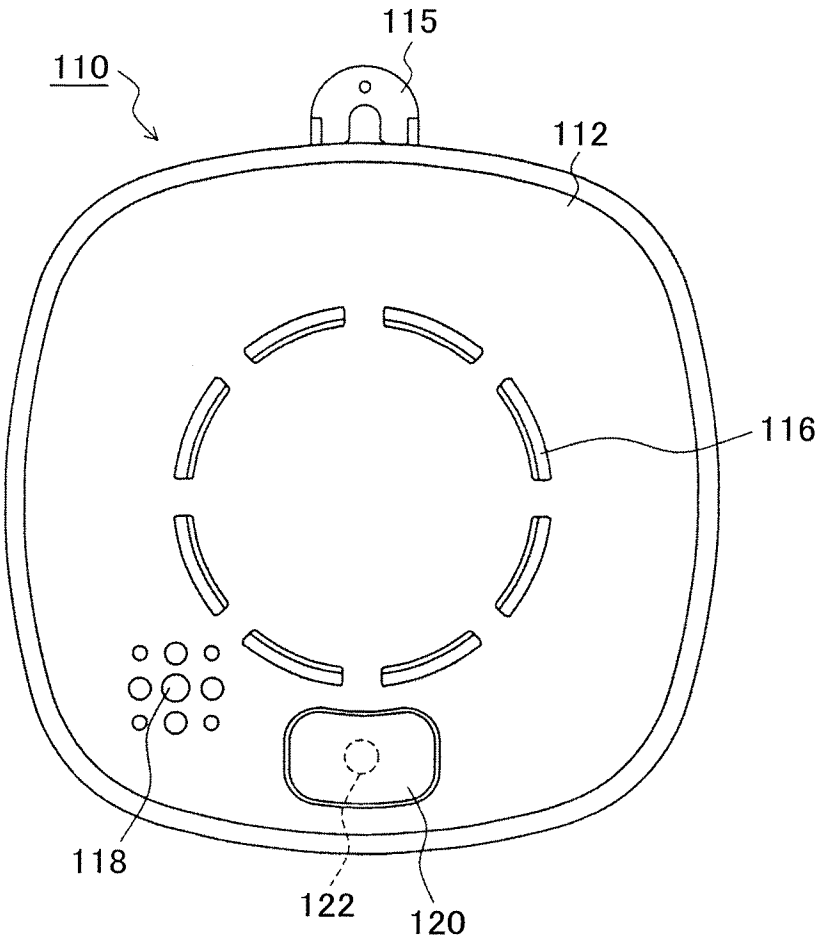
FIG. 8A is a front elevational drawing that shows the exterior appearance of the alarm device of the second embodiment of the present invention.

FIG. 8A and FIG. 8B show the exterior appearance of the wireless alarm device of the present embodiment, with FIG. 8A showing a front elevation, and FIG. 8B showing a side elevation.

In FIG. 8A and FIG. 8B, an alarm device 110 of the present embodiment is provided with a cover 112 and a main unit 114. A smoke detector section 116 in which openings that serve as smoke inlets are formed is arranged in the center of the cover 112, and when smoke from a fire reaches a predetermined density, it detects a fire.

As shown in FIG. 8A, a sound hole 118 is provided on the lower left side of the smoke detector section 116 of the cover 112. A speaker is built in at the rear of the sound hole 118 and is designed to be able to output an alarm sound or voice message through this sound hole 118. An alarm stop switch 120 is provided on the lower side of the smoke detector section 116. The alarm stop switch 120 also has a function as a check switch.

An LED 122 as shown by the dotted line is arranged within the alarm stop switch 120. When the LED 122 turns on, the light therefrom passes through the portion of the switch cover of the alarm stop switch 120, and so the turned-on state of the LED 122 can be confirmed from outside.

An mounting hook 115 is provided on the upper portion of the underside the main unit 114, and by screwing in a screw (not illustrated) into a wall of a room where it is to be installed, and attaching the mounting hook 115 onto this screw, it is possible to install the alarm device 110 on a wall.

Note that the alarm device 110 that is shown in FIG. 8A and FIG. 8B shows an example of the constitution that detects smoke from a fire with the smoke detector section 116, but in addition an alarm device that is provided with a thermistor that detects heat from a fire, or an alarm device that detects a gas leak besides a fire are included in the scope of the present invention.

Figure 9:
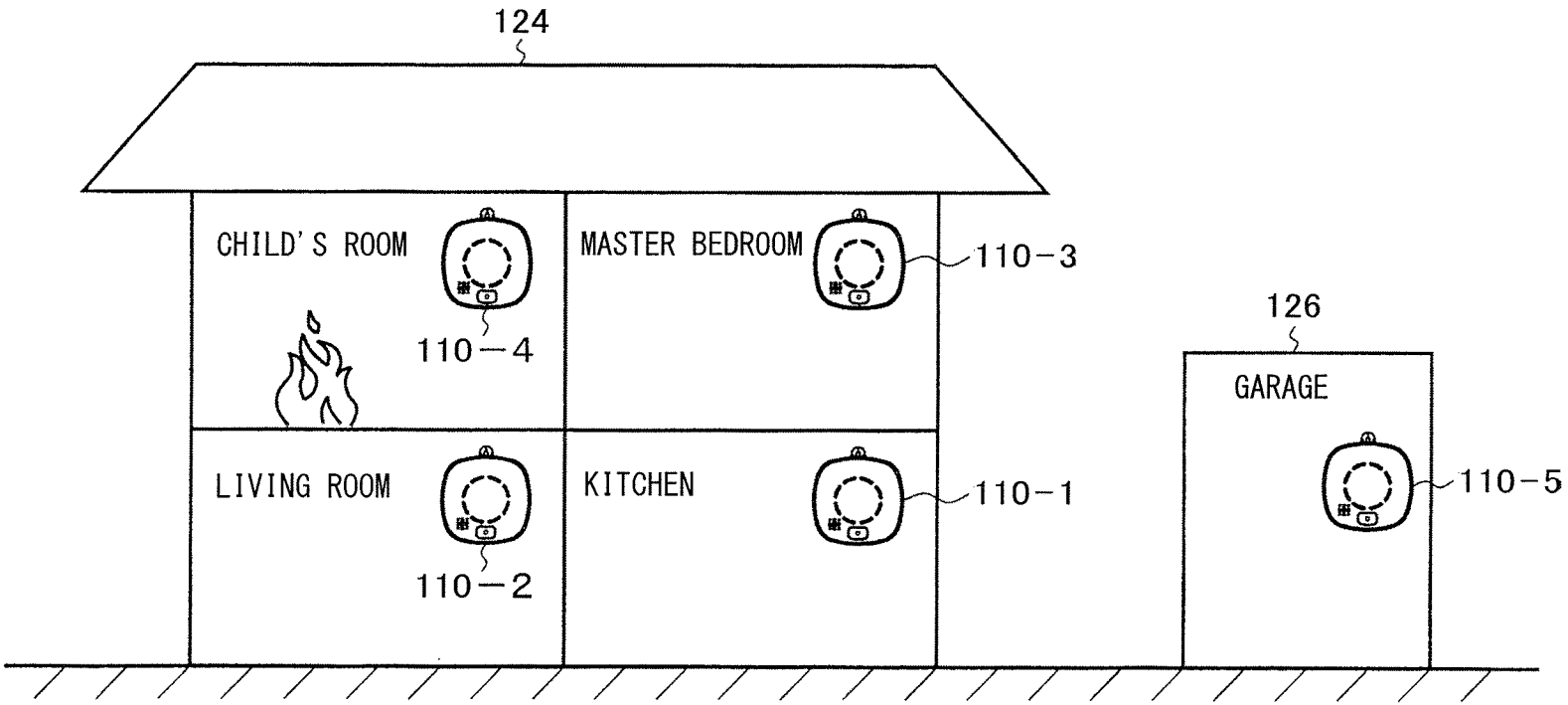
FIG. 9 is an explanatory drawing that shows the state of the alarm device installed in a residence.

FIG. 9 is an explanatory drawing that shows the state of the alarm device of the present embodiment installed in a residence. In the example of FIG. 9, alarm devices 110-1 to 110-4 of the present embodiment are installed in the kitchen, living room, master bedroom, and a child's room of a residence 124, and moreover, an alarm device 110-5 is installed in a garage 126 that is built outside.

The alarm devices 110-1 to 110-5 are each provided with a function to mutually transmit and receive wirelessly an event signal, and the five alarm devices 110-1 to 110-5 constitute one group to perform fire monitoring of the entire residence 124.

In the case of a fire occurring for example in the child's room of the residence 124, the alarm device 110-4 detects the fire and starts an alarm. The detection of the fire and starting of the alarm is called "alarm activation" in the alarm device. When the alarm device 110-4 activates an alarm, the alarm device 110-4 functions as the linked source, and transmits wirelessly the event signal that indicates a fire alarm activation to the other alarm devices 110-1 to 110-3 and 110-5 that serve as linked destinations. When the other alarm devices 110-1 to 110-3 and 110-5 receive the event signal that indicates fire alarm activation from the alarm device 110-4 that is the linked source, they perform an alarm operation as linked destinations.

As the alarm sound of the alarm device 110-4 that is the linked source, for example, the voice message "Woo Woo . . . The fire alarm has been activated. Please confirm" is output continuously. Meanwhile, in the linked destination alarm devices 110-1 to 110-3 and 110-5, the voice message "Woo Woo . . . Another fire alarm has been activated. Please confirm" is output continuously. In the state of the alarm devices 110-1 to 110-5 outputting the alarm sound, when the alarm stop switch 120 that is provided on the alarm device shown in FIG. 8A is operated, the stop process of the alarm sound is performed.

Also, the alarm devices 10-1 to 10-5 are provided with a low battery monitoring function that monitors the running down of the battery, and when it detects a low battery, for example, it intermittently outputs a "beep" alarm sound at a predetermined time interval, and reports that a failure has occurred. Also, the failure source alarm device that detected a low battery wirelessly transmits an event signal that indicates the occurrence of a low battery to the other alarm devices, and the same low battery alarm is output at the other alarm devices as well. As a result, when a low battery is detected in any alarm device, a failure alarm is output from all of the alarm devices that constitute the group that performs linked alarms.

Furthermore, in the alarm devices 110-1 to 110-5 of the present embodiment, when a low battery is detected, the normal discontinuous reception cycle T12 of the reception circuit 144 is changed to a longer discontinuous reception cycle T14 to lower the consumption current, and prolong the battery life. Also, when a low battery event signal is received from another alarm device, the normal transmission time T3 of the transmission circuit 142 is changed to a longer transmission time T5.

Note that the alarm devices 110-1 to 110-5 monitor for a sensor failure besides a low battery, and when they detect a sensor failure, perform a linked alarm in the same manner as the low battery detection.

Figure 10:
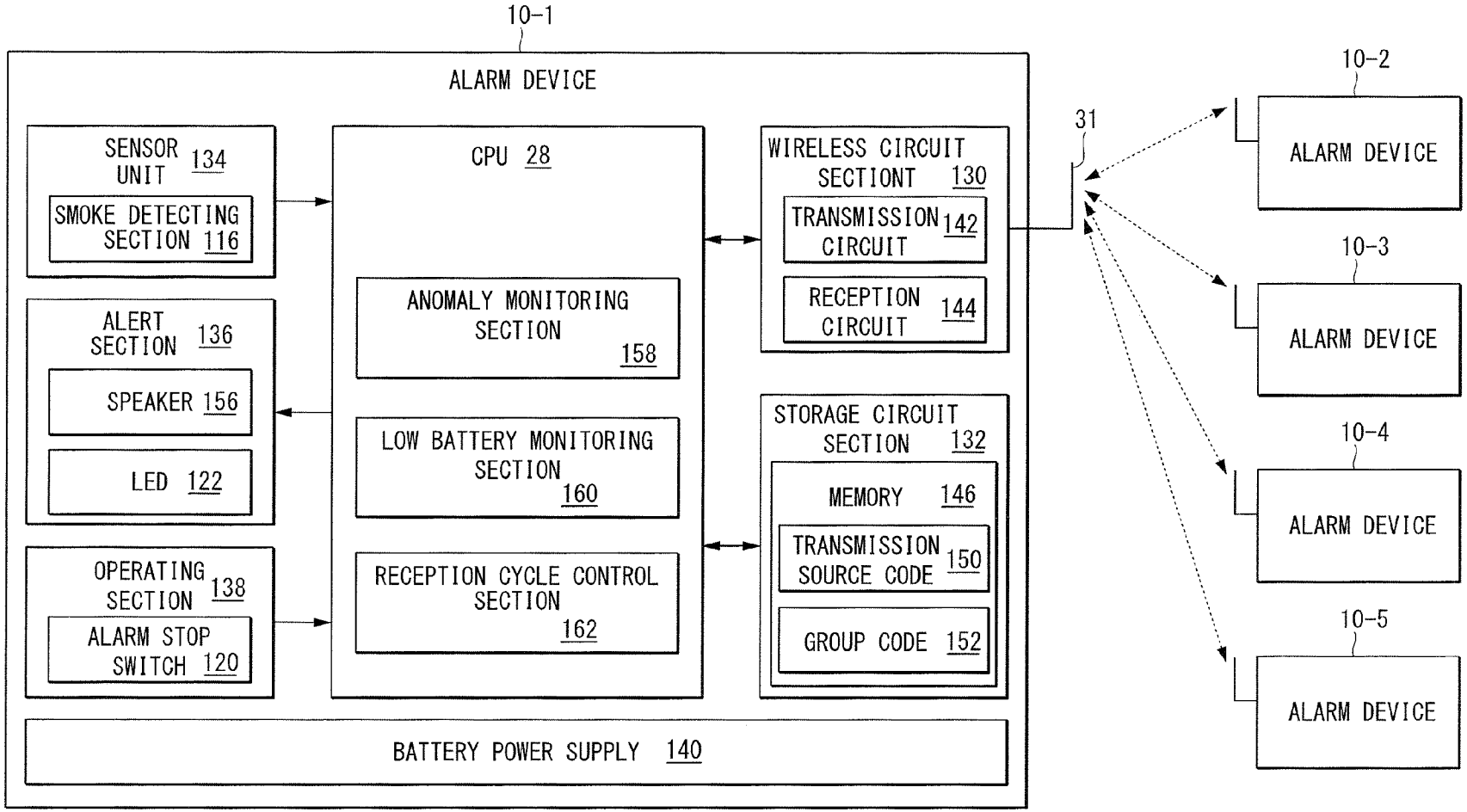
FIG. 10 is a block diagram of the alarm system that is used in the alarm device.

FIG. 10 is a block diagram that shows the alarm device of the present embodiment. FIG. 10 shows in detail the circuit configuration of the alarm device 110-1, among the five alarm devices 110-1 to 110-5 shown in FIG. 9.

The alarm device 110-1 is provided with a CPU 128. Also, corresponding to this CPU 128, it is further provided with a wireless circuit section 130 that is provided with an antenna 131, a storage circuit section 132, a sensor section 134, an alert section 136, an operating section 138, and a battery power supply 140.

The wireless circuit section 130 is provided with a transmission circuit 142 and a reception circuit 144, and is designed to be capable of wirelessly transmitting and receiving event signals to/from the other alarm devices 110-2 to 110-5. As the wireless circuit section 130, in Japan it is preferable to adopt a constitution based on for example STD-30, which is known as the standard for specified low-power radio stations in the 400 MHz band (ARIB Standard for Radio Equipment for Radio Station of Low Power Security System), or STD-T67 (ARIB Standard for Telemeter, Telecontrol and Data Transmission Radio Equipment for Specified Low Power Radio Stations).

Of course, as the wireless circuit section 130, for places outside of Japan, it is preferable to adopt a constitution that is based on the standard for allocated radio stations of that region.

The reception circuit 144 performs a discontinuous reception operation. The discontinuous reception operation of the reception circuit 144 consists of a reception operation time of for example T1=5 milliseconds, followed by a sleep time of for example T2=10 seconds, resulting in discontinuous reception with a cycle T12 (=T1+T2). Corresponding to this discontinuous reception, the transmission circuit 142 continuously transmits the event signal over time T3 that is at least the discontinuous reception cycle T12 (=T1+T2).

The discontinuous reception cycle T12 of the reception circuit 144 is a cycle that is determined at the design stage of the alarm device, so as to lead to average current consumption that ensures a battery life of for example 10 years, and is the default cycle that is set at the shipping stage.

Also, when a low battery is detected, the reception circuit 144 of the present embodiment is designed to be capable of changing the default discontinuous reception cycle T12 that is set in advance to a long discontinuous reception cycle T13 in order to extend battery life. With the change of the discontinuous reception cycle T12 to the longer cycle T13, the transmission time of the transmission circuit 142 of the alarm devices that have not detected a low battery is changed from the normal transmission time T3 to a longer transmission time 15.

A memory 146 is provided in the storage circuit section 132. A transmission source code 150 that serves as an ID (identifier) that specifies the alarm device, and a group code 152 for constituting a group that performs a linked alarm with a plurality of alarms as shown in FIG. 9 is housed in the memory 146. As for the transmission source code 150, the number of alarm devices to be provided domestically is calculated, and for example a code of 26 bits is used so that the same code does not overlap.

The group code 152 is a code that is set so as to be common for the plurality of alarm devices that constitute a group, and when the group code that is included in the event signal from another alarm device that is received by the wireless circuit section 130 matches the group code 152 that is registered in the memory 146, that event signal is received as a valid signal and processed.

Note that in the present embodiment, the memory 146 is used in the storage circuit section 132, but a DIP switch may be provided instead of the memory 146, so that the transmission source code 150 and the group code 152 may be set by this DIP switch. In the case of the bit length (bit number) of the transmission source code 150 and the group code 152 being short, the storage circuit section 132 that uses a DIP switch is preferred.

The smoke detector section 116 is provided in the sensor section 134, and outputs a smoke detection signal corresponding to the smoke density to the CPU 128. Besides the smoke detector section 116, a thermistor that detects the temperature from a fire may be provided. Also, in the case of an alarm device for detecting gas leaks, a gas leak sensor is provided in the sensor section 134.

The speaker 156 and the LED 122 are provided in the alert section 136. The speaker 156 outputs a voice message from a speech synthesis circuit section that is not illustrated or an alarm sound. The LED 122, by blinking and flashing, or turning on, indicates an anomaly such as a fire or a failure.

The alarm stop switch 120 and a transmission and reception time control section 62 are provided in the operating section 138. When the alarm stop switch 120 is operated, it is possible to stop the alarm sound that is sounding from the alarm device 110-1. The alarm stop switch 120 also doubles as a check switch in the present embodiment.

The alarm stop switch 120 is in effect when the alert section 136 is outputting an alarm sound from the speaker 156. On the other hand, during the normal monitoring state when an alarm sound is not being output, the alarm stop switch 120 functions as a check switch, and when the check switch is pushed, a voice message for inspection is output from the alert section 136.

The battery power supply 140 uses for example alkaline dry cells of a predetermined number, and regarding the battery capacity, a battery service life of about 10 years is ensured due to the reduced power consumption of the entire circuit section including the wireless circuit section 130 in the alarm device 110-1.

In the CPU 128, an anomaly monitoring section 158, a low battery monitoring section 160 and the transmission and reception time control section 162 are provided as functions that are realized by the execution of programs.

When the smoke detection signal from the smoke detector section 116 that is provided in the sensor section 134 exceeds the fire level and thus detects a fire, the anomaly monitoring section 158 causes the repeated output of an alarm sound indicating the linked source from the speaker 156 of the alert section 136, for example, "Woo Woo . . . The fire alarm has been activated. Please confirm", and causes the transmission of an event signal that indicates fire alarm activation from the antenna 31 to the other alarm devices 110-2 to 110-5 by the transmission circuit 142 of the wireless circuit section 130.

Also, when an event signal that indicates fire alarm activation has been received from any of the other alarm devices 110-2 to 110-5 by the reception circuit 144 of the wireless circuit section 130, the anomaly monitoring section 158 causes an alarm sound indicating the linked destination, for example, the voice message "Woo Woo . . . Another fire alarm has been activated. Please confirm" to be output continuously from the speaker 156 of the alert section 136.

Here, when the anomaly monitoring section 158 has detected a fire alarm activation and outputs the linked source alarm sound, the LED 122 of the alert section 136 is made to blink, for example. On the other hand, in the case of outputting a linked destination alarm sound, the LED 122 of the alert section 136 is made to flash. Thereby, it is possible to distinguish between the linked source alarm and the linked destination alarm from the indication of the LED 122. Of course, either of the linked source alarm and the linked destination alarm may be a blinking or flashing display of the same LED 122.

When the low battery monitoring section 160 has detected a low battery due to a voltage drop of the battery power supply 140, it emits a short low battery alarm sound such as a "beep" once every minute, for example, and transmits an event signal that indicates a low battery to the other alarm devices 110-2 to 110-5.

Here, when the battery voltage of the battery power supply 140 has dropped to a limit voltage at which the alarm device is capable of normally functioning over a predetermined remaining time, the low battery monitoring section 160 detects a low battery.

Also, when an event signal that indicates a low battery has been received from any of the other alarm devices 110-2 to 110-5, by intermittently outputting a low battery alarm sound in the same manner, the low battery monitoring section 160 performs linked output of the failure alarm sound. Warning of a low battery to the linked destinations may consist of causing the LED 122 to blink in synchronization with the alarm sound.

When a low battery is detected, the transmission and reception time control section 162 changes the discontinuous reception cycle T12 of the reception circuit 44 that has been initially set to a longer cycle T13 to extend the battery life, and on the other hand when an event signal denoting a low battery has been received from another alarm device, it changes the transmission time T3 of the transmission circuit 142 that has been initially set to a transmission time T5 that is at least the changed discontinuous reception cycle T13.

Figure 11:
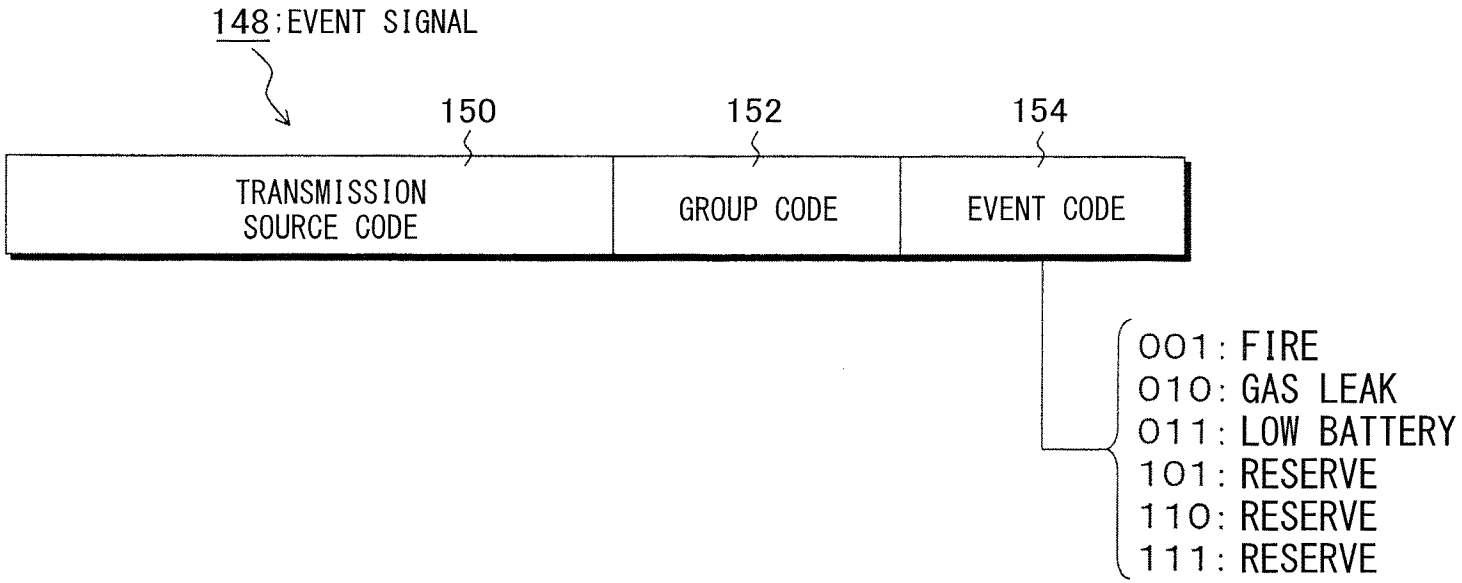
FIG. 11 is an explanatory drawing that shows the format of the event signal that is used in the embodiment.

FIG. 11 is an explanatory drawing that shows the format of the event signal used in the present embodiment. As shown in FIG. 11, an event signal 148 is constituted by the transmission source code 150, the group code 152, and the event code 154. The transmission source code 150 is for example a code of 26 bits. Also, the group code 152 is for example a code of 8 bits, and the same group code is set for the five alarm devices 110-1 to 110-5 of FIG. 10, for example, that constitute the same group.

Note that as the group code 152, in addition to setting the same group code for each alarm device of the same group, it may be a group code differing for each alarm device that is found from arithmetic of a reference code that is common to each alarm device that constitutes a group that is defined in advance, and a transmission source code that is unique to each alarm device.

The event code 154 is a code that expresses the event content of an anomaly such as a fire or gas leak or a failure. In the present embodiment, a three-bit code is used, with for example "001" denoting a fire, "010" denoting a gas leak, "011" denoting a failure, and the remainder serving as a reserve.

Note that by increasing the bit number of the event code 154 to four bits or five bits when the type of events has increased, it is possible to express several types of event contents.

Figure 12:
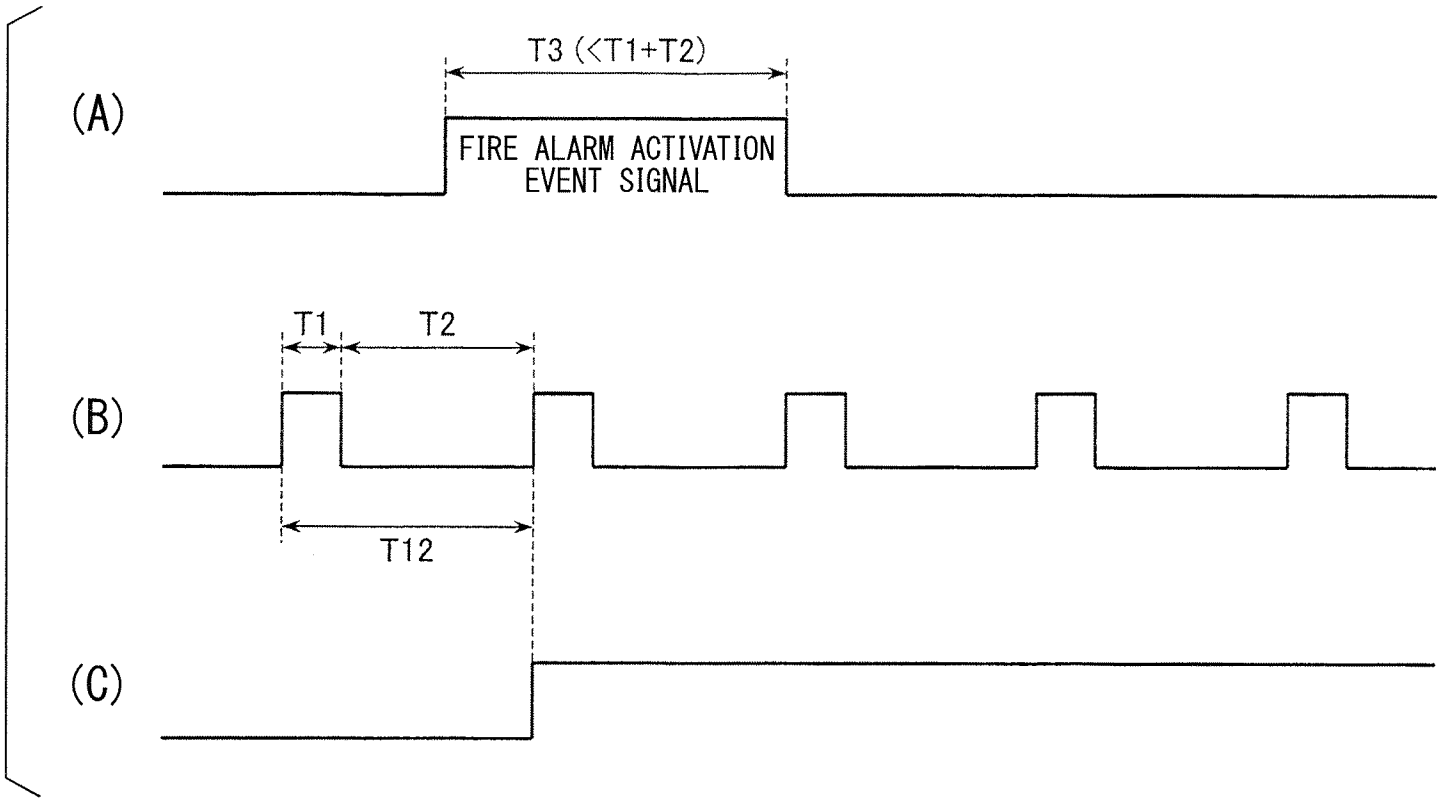
FIG. 12 is a time chart that shows the operation on the transmission side and the reception side during the initially set discontinuous reception cycle in the embodiment.

FIG. 12 is a time chart that shows the normal operation on the transmission side and the reception side in the present embodiment. In FIG. 12, (A) shows the transmission operation of the transmission side alarm device, (B) shows the reception operation of the reception side alarm device, and (C) shows the alarm output operation of the reception side alarm device.

As shown in (B) of FIG. 12, in the reception side alarm device, a discontinuous reception operation is performed at the discontinuous reception cycle T12 (=T1+T2) that consists of the reception operation time T1 and the sleep time T2 that are initially set during the normal monitoring state. Here, the reception operation time T1 is for example T1=5 milliseconds, and the sleep time T2 is for example T2=10 seconds, and so the discontinuous reception cycle T12 becomes T12=approximately 10 seconds.

In this state, when the transmission side alarm device performs fire alarm activation at an arbitrary timing, an event signal that indicates the fire alarm activation is transmitted as shown in (A) of FIG. 12. The transmission time T3 of the fire alarm activation event signal is made to be at least the discontinuous reception cycle T12. Thereby, even if the transmission timing is any timing, at least one reception time T1 occurs during the transmission time T3, and even if by discontinuous reception, it is possible to reliably receive the event signal, and to extend the battery life.

Figure 13:
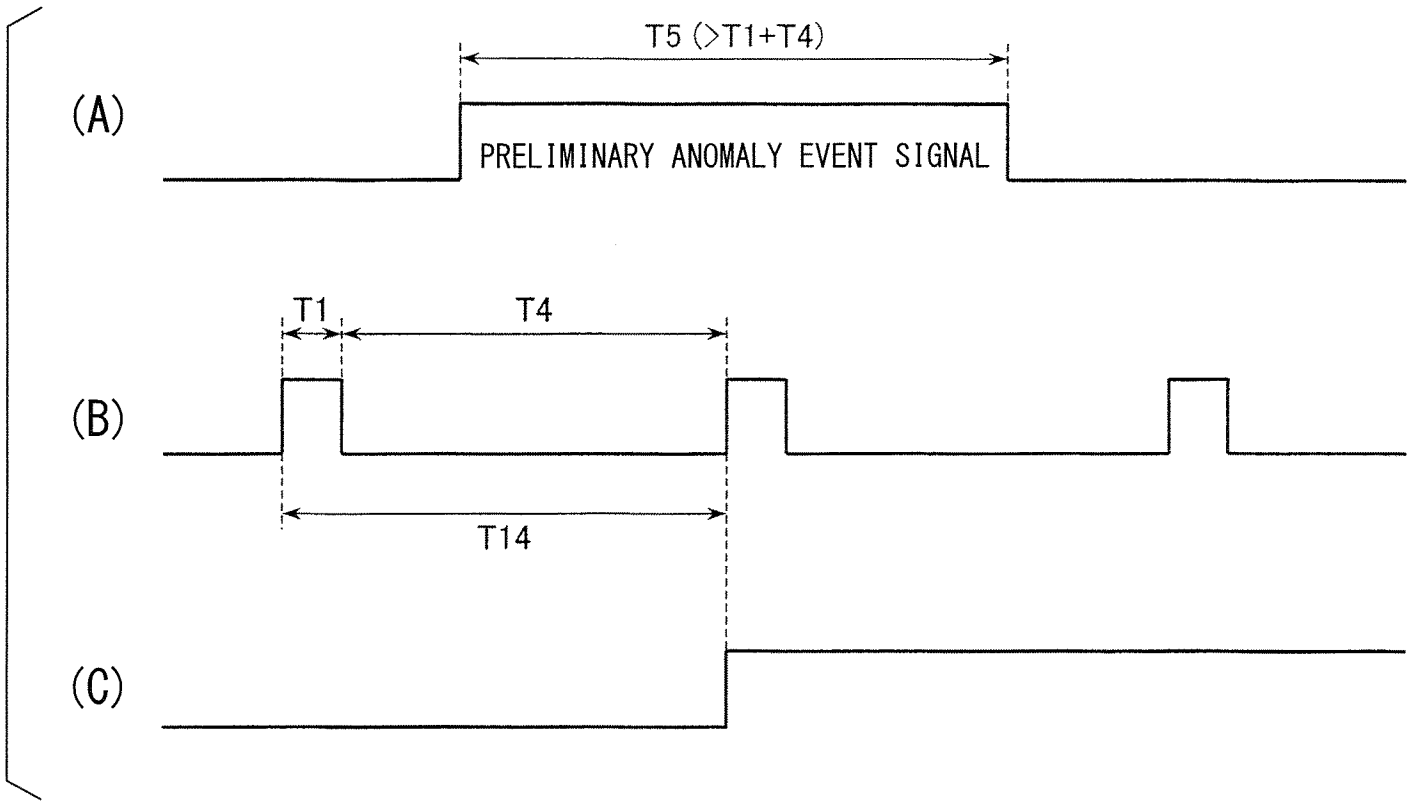
FIG. 13 is a time chart that shows the operation on the transmission side and the reception side in the case of changing the discontinuous reception cycle to a short cycle in the embodiment.

FIG. 13 is a time chart that shows the operation on the transmission side and the reception side during low battery detection in the present embodiment. In FIG. 13, (A) shows the transmission operation of the transmission side alarm device, (B) shows the reception operation of the reception side alarm device, and (C) shows the alarm output operation of the reception side alarm device.

In the reception side alarm device of (B) of FIG. 13, in response to the detection of a low battery, a discontinuous reception operation is performed with a discontinuous reception cycle T13 (=T1+T3) in which the reception operation time T1 remains as is, and the sleep time is extended from the hithertofore T2 time to T3 time. Here, as for the reception operation time T1, for example T1=5 seconds, and as for the sleep time T3, for example T3=20 seconds.

Figure 14:
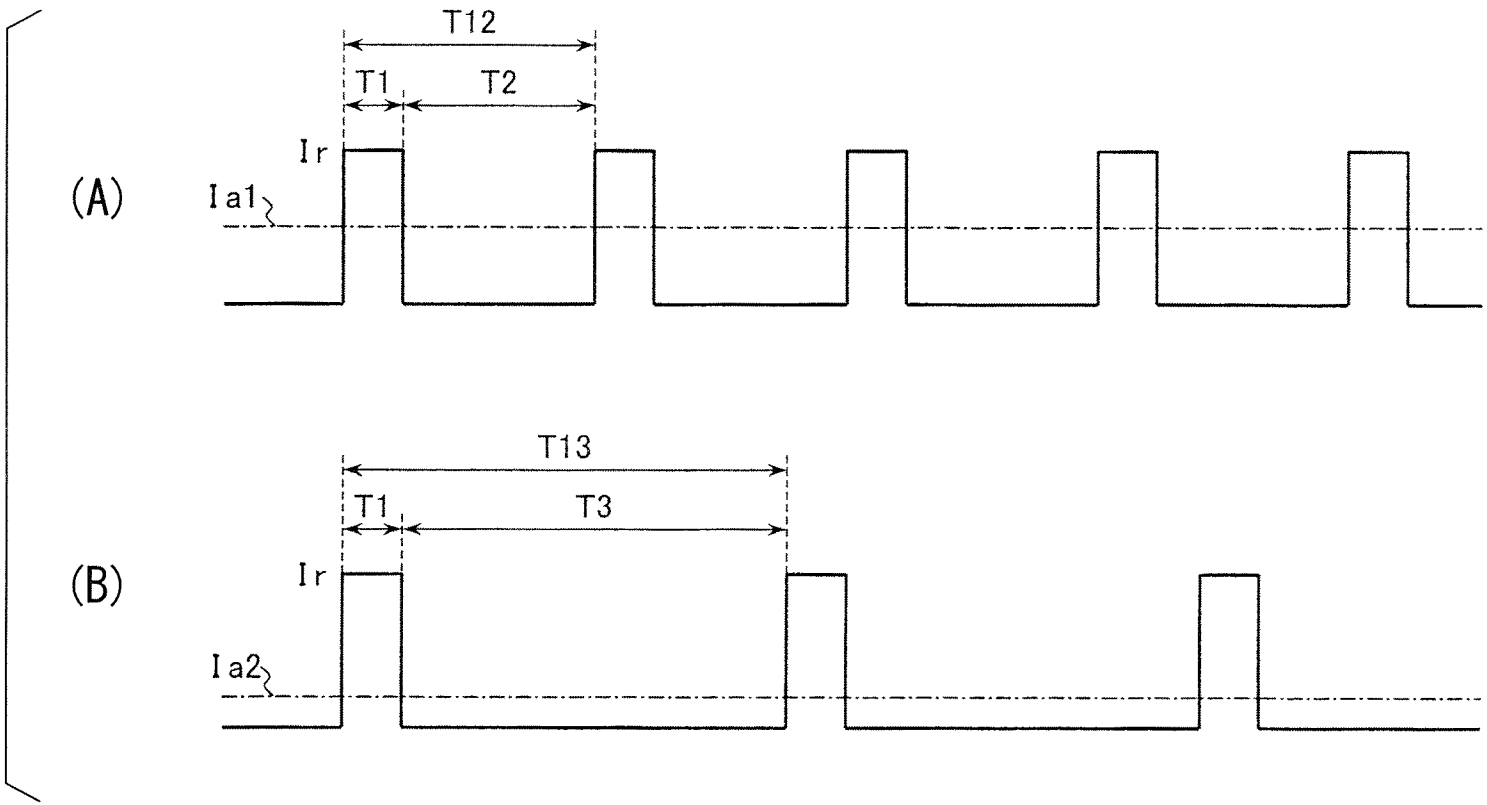
FIG. 14 is a time chart that shows the relation of the discontinuous reception cycle and the average consumption current in the embodiment.

FIG. 14 is a time chart that shows the relationship between the discontinuous reception cycle and the average consumption current in the present embodiment. (A) of FIG. 14 is the discontinuous reception operation in the discontinuous reception cycle T12 at normal times, and the average current Ia1 in this case is given by $$Ia1=(Ir\times T1)/T12$$

(B) of FIG. 14 is the case of changing the discontinuous reception cycle T12 to a longer discontinuous reception cycle T14, based on the detection of a low battery, and the average current Ia2 in this case is given by $$Ia2=(Ir\times T1)/T14$$

For this reason, as a result of the discontinuous reception cycle T12 being changed to the longer discontinuous reception cycle T14 when a low battery is detected, even if the battery power supply 140 is in a low battery state, it is possible to reduce the consumption current of the reception circuit 144, and thus to extend as much as possible the battery life.

Figure 15:
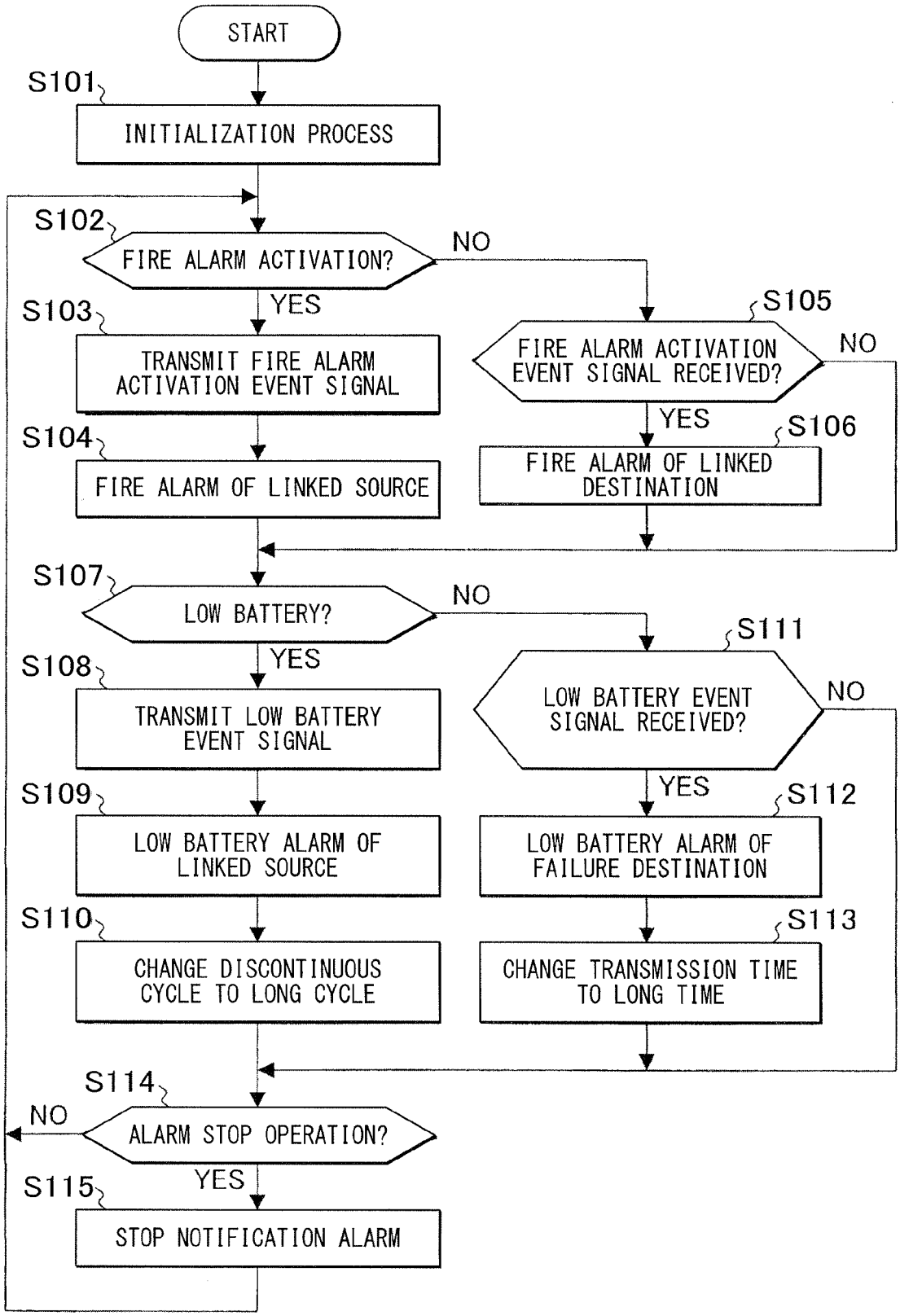
FIG. 15 is a time chart that shows the fire monitoring process that accompanies a linked alarm in the embodiment.

FIG. 15 is a flowchart that shows the process by the CPU 128 that is provided in the alarm device 110-1 of FIG. 10. When the battery power supply of the alarm device is made effective (ON), in Step S101, an initialization process is performed. In this initialization process is included a process of setting a linked group with the alarm devices 110-1 to 110-5.

Next, the alarm device enters the monitoring state, and in Step S102, the presence of a fire alarm activation by the smoke detector section 116 that is provided in the sensor section 132 is determined. When a fire alarm activation is determined, the process proceeds to Step S103, and after transmitting the fire alarm activation event signal to the other alarm devices 110-2 to 110-5, in Step S104 the fire alarm of the linked source is acoustically output from the speaker 156 of the alert section 136 and the LED 122 is controlled to turn on.

Meanwhile, in the case of a fire alarm activation not being determined in Step S102, the process proceeds to Step S105, in which it is determined whether or not a fire alarm activation event signal has been received from another alarm device, and when the reception of a fire alarm activation event signal is determined, a fire alarm of the linked destination is output in Step S106.

Next, in Step S107 the presence of a low battery detection is determined, and if low battery detection is determined, the process proceeds to Step S108, and after transmitting an event signal that shows a low battery to the other alarm devices 110-2 to 110-5, a discontinuous linked source low battery alarm is output in Step S109.

Then, in Step S110, the discontinuous cycle of the reception circuit 144 is changed from the initially set cycle T12 to, for example, a cycle T14 that is double. On the other hand, when a low battery is not detected in Step S107, the presence of the reception of an event signal that shows a low battery from the other alarm devices 110-1 to 110-5 is determined in Step S111. In the case of an event signal that shows a low battery being received, a discontinuous linked destination low battery alarm is output in Step S112. Furthermore, the reception operation time of the reception circuit 144 is changed from the normal T3 time to the longer T5 time.

Next, in Step S114 when the alarm stop operation during an alarm is determined, the alarm sound is stopped in Step S115.

Note that the aforementioned embodiment is one that takes as an example an alarm device that is intended for fire detection, but it is possible to apply as is the monitoring process that includes the preliminary anomaly of the present embodiment for an alarm device that detects other anomalies, such as an alarm device for gas leaks or an alarm device for crime prevention. Also, it is not limited to residences, and can be also applied to alarm devices catering to various uses such as for buildings and offices.

Also, the aforementioned embodiment is one that takes as an example the case of integrally providing the sensor section in the alarm device, but as another embodiment it may also be an alarm device in which the sensor section is provided separately from the alarm device.

Also, the present invention is not limited to only the aforementioned embodiments, and includes suitable modifications that do not impair the objects and advantages thereof, and furthermore is not subject to limitations by only the numerical values shown in the aforementioned embodiments.

INDUSTRIAL APPLICABILITY

According to the alarm device of the present invention, it is possible to increase reliability by extending as much as possible the remaining time until a battery runs down even if a low battery alarm has been emitted.

The invention claimed is:

1. An alarm device comprising:

a battery power supply;

a sensor section that outputs an anomaly detection signal in the case of detecting an anomaly;

an alert section that outputs an alarm based on the anomaly detection signal;

a reception circuit section that discontinuously performs a reception operation to receive an event signal from another alarm device at every predetermined reception cycle consisting of a reception operation time and a sleep time;

a transmission circuit section that transmits an event signal to the other alarm device in a transmission time that is longer than the predetermined reception cycle;

an anomaly monitoring section that, when the sensor section has detected an anomaly, causes the alert section to output a linked source anomaly alarm based on the anomaly detection signal and causes the transmission of an event signal relating to the anomaly of the alarm device to the other alarm device by the transmission circuit section, and when the reception circuit section has received from the other alarm device an event signal relating to an anomaly of the other alarm device, causes the alert section to output a linked destination anomaly alarm; and a low battery monitoring section that, upon detecting a voltage drop of the battery power supply, causes a low battery alarm of the alarm device to be output by the alert section, wherein the battery power supply supplies a power to a circuit provided with at least the transmission circuit section and the reception circuit section, during a normal monitoring state, the low battery monitoring section detects the low battery when a voltage of the battery power drops to a limit voltage at which the alarm device can maintain an alert state over a predetermined remaining time, and upon detecting the low battery, stops a supply of the power to the reception circuit section and the transmission circuit section while maintaining the supply of the power to other circuit sections so that the alarm device functions as the alarm device which does not perform linked alarm output with the other alarming device over the predetermined remaining time.

2. An alarm device comprising:

a battery power supply;

a sensor section that outputs an anomaly detection signal in the case of detecting an anomaly;

an alert section that outputs an alarm based on the anomaly detection signal;

a reception circuit section that discontinuously performs a reception operation to receive an event signal from another alarm device at every predetermined reception cycle;

a transmission circuit section that transmits an event signal to the other alarm device in a transmission time that is longer than the predetermined reception cycle;

an anomaly monitoring section that, when the sensor section has detected an anomaly, causes the alert section to output the anomaly alarm based on the anomaly detection signal and causes the transmission of an event signal relating to the anomaly of the alarm device to the other alarm device by the transmission circuit section, and when the reception circuit section has received from the other alarm device an event signal relating to an anomaly of the other alarm device, causes the alert section to output the anomaly alarm;

a low battery monitoring section that causes the output from the alert section of a low battery alarm that announces a voltage drop of the alarm device and the other alarm device; and a transmission and reception time control section that controls the transmission time of the transmission circuit section and the predetermined reception cycle of the reception circuit section;

wherein when a voltage drop of the battery power supply is detected, the low battery monitoring section causes the alert section to output a low battery alarm of the alarm device, and causes the transmission circuit section to transmit an event signal relating to the voltage drop of the alarm device to the other alarm device, and the transmission and reception time control section changes the predetermined reception cycle of the reception circuit section to a long reception cycle that is longer than the predetermined reception cycle; and when an event signal relating to a voltage drop of the other alarm device is received from the other alarm device, the low battery monitoring section causes the alert section to output a low battery alarm of the other alarm device, and the transmission and reception time control section changes the transmission time of the transmission circuit section to a time equal to or greater than the long reception cycle.

3. The alarm device according to claim 2, wherein the low battery monitoring section detects the voltage drop when the battery voltage has dropped to a limit voltage at which the alarm device can maintain an alert state over a predetermined remaining time.

4. The alarm device according to claim 1, wherein the reception circuit section sets the predetermined reception cycle based on an average consumption current ensuring a predetermined battery life.

* * * * *